US007133530B2

(12) United States Patent
Poletti

(10) Patent No.: US 7,133,530 B2
(45) Date of Patent: Nov. 7, 2006

(54) MICROPHONE ARRAYS FOR HIGH RESOLUTION SOUND FIELD RECORDING

(75) Inventor: Mark Alistair Poletti, Lower Hutt (NZ)

(73) Assignee: Industrial Research Limited, Lower Hutt (NZ)

( * ) Notice: Subject to any disclaimer, the term of this patent is extended or adjusted under 35 U.S.C. 154(b) by 502 days.

(21) Appl. No.: 10/182,166

(22) PCT Filed: Feb. 2, 2001

(86) PCT No.: PCT/NZ01/00010

§ 371 (c)(1),
(2), (4) Date: Jul. 25, 2002

(87) PCT Pub. No.: WO01/58209

PCT Pub. Date: Aug. 9, 2001

(65) Prior Publication Data

US 2003/0063758 A1 Apr. 3, 2003

(30) Foreign Application Priority Data

Feb. 2, 2000 (NZ) ..... 502603

(51) Int. Cl.
*H04R 3/00* (2006.01)

(52) U.S. Cl. ..... 381/92

(58) Field of Classification Search ..... 381/92, 381/98, 103

See application file for complete search history.

(56) References Cited

U.S. PATENT DOCUMENTS 4,042,779 A * 8/1977 Craven et al. ..... 381/103
4,311,874 A 1/1982 Wallace, Jr.
4,696,043 A 9/1987 Iwahara et al.
5,058,170 A 10/1991 Kanamori et al.
5,473,701 A 12/1995 Cezanne et al.
5,511,130 A 4/1996 Bartlett et al.
5,586,191 A 12/1996 Elko et al.
5,715,319 A 2/1998 Chu
5,737,430 A 4/1998 Widrow
5,848,172 A 12/1998 Allen et al.
6,041,127 A * 3/2000 Elko ..... 381/92
6,072,878 A 6/2000 Moorer (Continued)

FOREIGN PATENT DOCUMENTS

EP 0381498 8/1990

(Continued)

OTHER PUBLICATIONS

T. Rahim et al., "Effect of directional elements on the directional response of circular antenna arrays," IEE Proc., vol. 129, Feb. 1982.

(Continued)

*Primary Examiner*—Brian T. Pendleton
(74) *Attorney, Agent, or Firm*—Dann, Dorfman, Herrell and Skillman, P.C.

(57) ABSTRACT

A circular transducer array (30) is provided for use in recording a sound field. The array (30) comprises a plurality of microphones (31*a*–31*h*), a digital signal processor (33), frequency compensation filters (34) and a sum and difference network (35). The digital signal processor calculates the Fourier transform of sampled output signals from the transducers to produce a plurality of sound wave components specifying the sound field. The frequency compensation network (34) equalises each component using Bassel functions to flatten the apparent response of the array (30) and the sum and difference network (35) then combines the equalised components to provide a plurality of audio signals which represent the sound field.

44 Claims, 14 Drawing Sheets

U.S. PATENT DOCUMENTS

| | | | | |
|---|---|---|---|---|
| 6,925,189 | B1 * | 8/2005 | Koroljow et al. | 381/313 |
| 2001/0031053 | A1 * | 10/2001 | Feng et al. | 381/92 |

FOREIGN PATENT DOCUMENTS

| | | |
|---|---|---|
| WO | WO9613958 | 5/1996 |

OTHER PUBLICATIONS

J. Meyer, "Beamforming for a circular microphone array mounted on spherically shaped objects," J. Accoust. Soc. Am., vol. 109, No. 1, Jan. 2001.

* cited by examiner

MICROPHONE ARRAYS FOR HIGH RESOLUTION SOUND FIELD RECORDING

FIELD OF THE INVENTION

The present invention relates to an apparatus and method for use in the recording of sound fields. In particular it relates to a microphone array and associated hardware for producing a plurality of audio signals which represent a sound field to be recorded. The apparatus and method can be implemented in surround-sound, stereophonic and teleconferencing systems, although is not limited to such use.

BACKGROUND TO THE INVENTION

Previous microphones have been developed primarily for use in sound reinforcement systems and for monophonic and stereophonic recording. Pressure microphones have an omnidirectional response, being equally sensitive to sounds arriving from all directions. First order gradient microphones were developed to provide a variety of directional responses, which can increase the potential acoustic gain in sound reinforcement systems in reverberant environments. These microphones also allow stereophonic recording with acceptable imaging within the loudspeaker angles. The gradient microphone is in many cases implemented as two closely spaced pressure elements with their outputs subtracted. This produces an approximation to the gradient, and a signal proportional to the sound velocity is obtained by integrating the difference signal.

Second order gradient microphones have also been developed which provide greater discrimination between sound from different angles of arrival. These typically consist of two gradient elements—each often consisting of two pressure elements—which produce the second spatial derivative with respect to one, or two axes. A pure second order response is obtained using the derivative with respect to two axes, and the four pressure elements form a square with their outputs combined with amplitudes of plus or minus one. This array produces a sin (2θ) polar response. A second square array is obtained by rotating the first by 45 producing a cos (2θ) response. If the outputs are integrated twice, then at low frequencies the response is constant with frequency. Alternative implementations consist of two pressure gradient elements, or a single diaphragm open to the atmosphere at four points, with two openings to one side of the diaphragm and two openings connected to the other to produce the appropriate signs.

Higher order devices may also be built using three or more gradient elements and similar implementation methods to that of the second order microphones. For each order m, an mth order integration is required to produce a flat response with frequency.

An alternative method for improving the discrimination of a microphone is to use two or more individual microphones, and to combine their outputs to produce one or more outputs which have higher directivity than a single element. More complex systems may be built using a larger array of microphones. Typically, prior art examples consist of a straight line of microphones with either equal or different inter-microphone separations, and use beam forming principles to produce one or more beams with sharp directivity in one or more directions.

Surround sound systems offer the potential for improved sound localisation over stereo systems. Early quadraphonic systems brought to light some of the issues that affect the quality of reproduction, in particular the limitations of small numbers of loudspeakers, and the importance of the functions used to place individual sound sources in the 360 degree sound field. The ambisonics system was developed independently by several researchers, and has proved to be a low order approximation to the holographic reconstruction of sound fields. The sound field is recorded using microphones that measure the spherical harmonics of the sound field at (theoretically) a point. The performance of the system becomes more accurate over wider areas as the number of loudspeakers and the number of spherical harmonics of the recorded sound field are increased.

All current ambisonics systems are first order: that is, they use a recording microphone which records only the zeroth (pressure) and first (x, y and z components of velocity) responses. A prior art microphone designed specifically for this purpose is the Soundfield microphone. Since only the first spherical harmonic, also termed spatial harmonic in the art, is available, the resulting reproduction demonstrates poor localisation.

Most surround systems use only the horizontal (x and y) components of the velocity, since a) lateral localisation is more acute than vertical localisation, and b) the use of the z component requires loudspeakers to be positioned above the listener, which is often impractical. In this case the spatial harmonics are obtained from microphones with azimuthal polar responses of the form cos (mθ) and sin (mθ). Each spherical harmonic greater than order zero therefore requires 2 channels. The total number of channels required to transmit or record all spatial harmonics up to order M is thus 2M+1.

Modem surround sound systems typically use five loudspeakers, and it has been shown that this allows the use of microphones which can measure up to the second order spherical harmonics of the sound field, requiring five channels. Surround systems using more than five loudspeakers will allow harmonics of orders greater than 2, and higher numbers of channels are required—for example, the inclusion of third order spherical harmonics require seven channels.

The recently introduced DVD-Audio disk allows the recording of six channels of audio. It is thus capable of carrying recordings from second order microphone systems. Future audio disk technology will provide greater numbers of channels. While some second and higher order microphones have been developed in the past, there are currently no microphone systems commercially available which can measure spherical harmonics of order two or greater. There is thus a technology mismatch between the reproduction capability that DVD disks offer and the recording technology that current microphones can provide. A practical need therefore exists for the development of microphone systems that can accurately record the higher spherical harmonics of sound fields in the horizontal plane, and in particular, the second order responses.

Consider a general sound pressure field p(x,y,z,t). The pressure in the plane z=0 is a three-dimensional function of x,y and t. This three-dimensional function may be equivalently expressed in terms of its three-dimensional Fourier transform $$P(\vec{k},\omega)=\int\int_{-\infty}^{\infty}p(x,y,t)e^{-j\left[\omega t+\vec{k}\cdot\vec{r}\right]}dt\,d\vec{r} \tag{1}$$

where $\vec{k}$ is the vector wavenumber and $(-j\vec{k}\cdot\vec{r})$ is chosen so that the pressure is represented by incoming waves which is relevant in surround systems, as opposed to outgoing waves in some texts. This equations shows that any sound field in the horizontal plane z=0 can be expressed as a sum of plane waves.

Writing $\vec{k}$ in terms of its two components u=k cos (θ) and v=k sin (θ), where $k=|\vec{k}|$, this may be written $$P(u, v, \omega) = \int_{-\infty}^{\infty}\int_{-\infty}^{\infty}\int_{-\infty}^{\infty} p(x, y, t)e^{-j(\omega t+ux+vy)}\,dt\,dx\,dy \tag{2}$$

As an example, a complex plane wave with radian frequency $\omega_0$, magnitude B, phase φ and angle of incidence $\theta_0$ has the form $$p(x, y, t)=Be^{j[\omega_0 t+\phi+k_0 \cos(\theta_u)x+k_0 \sin(\theta_0)y]} \tag{3}$$

where $k_0=\omega_0/c$ and c is the speed of sound. The Fourier transform is $$P(u, v, \omega)=A(2\pi)^3\,\delta(u-k_0\cos(\theta_0))\delta(v-k_0\sin(\theta_0))\delta(\omega-\omega_0) \tag{4}$$

where, for convenience, $A=Be^{j\phi}$ is the complex amplitude. The "spectrum" consists of a delta function at as $\omega=\omega_0$, u=k cos ($\theta_0$), v=k sin ($\theta_0$). Since P(u, v, ω) exists only at one point, it may be represented as a vector 10 in wavenumber-frequency space 11, as shown in FIG. 1. In the (u,v) plane, the vector 10 has a projection 12 which is a vector of radius $k_0=\omega_0/c$ and angle $\theta_0$ relative to the u axis.

A real plane wave is given by the real part of equation 3, $$p_R(x, y, t) = \frac{1}{2}Ae^{j[\omega_0 t+k_0\cos(\theta_0)x+k_0\sin(\theta_0)y]} + \frac{1}{2}A^*e^{-j[\omega_0 t+k_0\cos(\theta_0)x+k_0\sin(\theta_0)y]} \tag{5}$$

which can be written $$p_R(x, y, t) = \frac{1}{2}Ae^{j\omega_0 t+jk_0[\cos(\theta_0)x+\sin(\theta_0)y]} + \frac{1}{2}A^*e^{-j\omega_0 t+k_0[\cos(\theta_0+x)x+k_0\sin(\theta_0+\pi)y]} \tag{6}$$

The second term consists of a negative frequency complex plane wave with conjugate phase and the same positive wavenumber $k_0$ propagating in the opposite direction $\theta_0+\pi$. The spectrum may be represented as two vectors in (u, v, ω) space. As $\omega_0$ and $\theta_0$ vary, the two vectors trace out a cone shape, since k=ω/c. Thus the spectrum of any two-dimensional spatial pressure field lies in the cone ω=±ck in the three-dimensional (u, v, ω) space.

The pressure field is obtained from P(u, v, ω) by the inverse Fourier transform $$p(x, y, t) = \frac{1}{(2\pi)^3}\int_{-\infty}^{\infty}\int_{-\infty}^{\infty}\int_{-\infty}^{\infty} P(u, v, \omega)e^{j[\omega t+uv+vy]}\,du\,dv\,d\omega \tag{7}$$

Writing P(u, v, ω) in terms of spatial polar coordinates, u=k cos (θ), v=k sin (θ), and p(x, y, t) in terms of polar coordinates x=r cos (θ), y=r sin (θ) yields $$p(r, \phi, t) = \frac{1}{(2\pi)^3}\int_{-\infty}^{\infty}\int_{0}^{\infty}\int_{0}^{2\pi} P(k, \theta, \omega)e^{j[\omega t+kr\cos(\theta-\phi)]}k\,dk\,d\theta\,d\omega \tag{8}$$

Since k=ω/c the integral over ω is only nonzero for ω=±kc. Hence $$P(k, \theta, \omega)=P(k, \theta, \omega)2\pi[\delta(\omega-kc)+\delta(\omega+kc)] \tag{9}$$

and so $$p(r, \phi, t) = \frac{1}{4\pi^2}\int_{0}^{\infty}\int_{0}^{2\pi} P(k, \theta, kc)e^{jk[ct+r\cos(\theta-\phi)]}k\,dk\,d\theta + \frac{1}{4\pi^2}\int_{0}^{\infty}\int_{0}^{2\pi} P(k, \theta, -kc)e^{jk[-ct+r\cos(\theta-\phi)]}k\,dk\,d\theta \tag{10}$$

There are two special cases of interest. In the first, the signal contains only positive frequencies, (for example the complex plane wave considered above) and the pressure field is analytic. In this case the second integral is zero, and the analytic pressure field is $$p_a(r, \phi, t) = \frac{1}{4\pi^2}\int_{0}^{\infty}\int_{0}^{2\pi} P(k, \theta, kc)e^{jk[ct+r\cos(\theta-\phi)]}k\,dk\,d\theta \tag{11}$$

The analytic case is useful for the analysis and design of surround systems.

The second case of interest is real pressure fields, which occur in practice. In this case the spectrum in polar coordinates has the property $$P(k, \theta, -kc)=P^*(k, \theta+\pi, kc) \tag{12}$$

Substituting this in equation 10

$$p_R(r, \phi, t) = \frac{1}{4\pi^2}\int_{0}^{\infty}\int_{0}^{2\pi} \mathrm{Re}\{P(k, \theta, kc)e^{jk[ct+r\cos(\theta-\phi)]}\}k\,dk\,d\theta \tag{13}$$

Equations 11 and 13 both show that the pressure field is completely specified by a two dimensional spectrum S(k, θ)=kP(k, θ, kc) which specifies at each frequency, the complex amplitude of the plane wave arriving from each angle θ. S(k, θ) may be termed the frequency-dependent source distribution. Since it is periodic in θ, it can be expanded in a Fourier series $$S(k, \theta) = \sum q_m(k)e^{jm\theta} \tag{14}$$

The coefficients $q_m(k)$ are thus the "angular spectrum" of S(k, θ) at each spatial frequency k, given by $$q_m(k) = \frac{1}{2\pi}\int_{0}^{2\pi} S(k, \theta)e^{-jm\theta}\,d\theta \tag{15}$$

The analysis is further simplified by examining each frequency component separately. In this case the sound field is "monochromatic", consisting of complex plane waves of the same frequency $\omega_0$ arriving from all directions θ. In this case $$P(k, \theta, kc) = \frac{1}{k}S(k, \theta) = \frac{2\pi}{k_0}\delta(k - k_0)S_0(\theta) \tag{16}$$

where $S_0(\theta)=S(k_0, \theta)$. Substituting this in equation 11 yields $$p_0(r, \phi, t) = e^{j\omega_0 t}\frac{1}{2\pi}\int_0^{2\pi} S_0(\theta)e^{jkr\cos(\theta-\phi)}\,d\theta \tag{17}$$

Thus a monochromatic sound field is expressed in terms of its one-dimensional source distribution. A simple example is a single plane wave with complex amplitude Λ arriving from direction $\theta_0$. The source distribution is a delta function at $\theta=\theta_0$ and thus $$S_{0\theta_0}(\theta) = 2\pi A\sum_{m=-\infty}^{\infty}\delta(\theta - \theta_0 - 2m\pi) = A\sum_{m=-\infty}^{\infty} e^{jm(\theta-\theta_0)} \tag{18}$$

and so the angular spectrum is $$q_m = Ae^{-jm\theta_0} \tag{19}$$

The monochromatic sound field may be written directly in terms of the spectrum of $S_0(\theta)$ by substituting from equation 14, $$p_0(r, \phi, i) = e^{j\omega_0 t}\sum_{m=-\infty}^{\infty} q_m\frac{1}{2\pi}\int_0^{2\pi} e^{j[m\theta+k_0 r\cos(\theta-\phi)]}\,d\theta \tag{20}$$

which, with the identity $$j^n J_n(z) = \frac{1}{2\pi}\int_0^{2\pi} e^{j[n\theta+z\cos(\theta)]}\,d\theta \tag{21}$$

yields $$p_0(r, \phi, t) = e^{j\omega_0 t}\sum_{m=-\infty}^{\infty} j^n J_m(k_0 r)q_m e^{jm\phi} \tag{22}$$

This shows that the angular pressure field at radius r may be written as a sum of terms of the form exp(jmϕ). These have been termed "phase modes" in antenna array literature and the same terminology will be used here. The magnitude of each phase mode is the spectral coefficient multiplied by a Bessel function of the first kind which describes how the phase mode varies radially.

An important feature of equation 22 is that for small $k_0r$ the Bessel functions of high orders are small and may be neglected without significantly affecting the pressure. Hence, for low frequencies, or for small radii, the phase mode expansion may be truncated to some maximum order m=±M . However, as the frequency or radius increases, M must increase to preserve the accuracy of the expression.

As an example, the pressure due to a single plane wave at angle $\theta_0$ is obtained from equations 19 and 22 with $q_m$=A exp $(-jm\theta_0)$ $$p_{0\theta_0}(r, \phi, t) = Ae^{j\omega_0 t}\sum_{m=-\infty}^{\infty} j^m J_m(k_0 r)e^{jm(\phi-\theta_0)} \tag{23}$$

Thus the pressure field due to a plane wave consists of phase modes with magnitudes given by Bessel functions.

By adding the terms in equation 22 m=l and m=−l, and noting that $J_{-m}(z)=(-1)^m J_m(z)$, the phase mode expansion may be written $$p_0(r, \phi, t) = e^{j\omega_0 t}\left[q_0 J_0(kr) + \sum_{m=1}^{\infty} j^m[q_m + q_{-m}]J_m(k_0 r)\cos(m\phi) + j\sum_{m=1}^{\infty} j^m[q_m - q_{-m}]J_m(k_0 r)\sin(m\phi)\right] \tag{24}$$

Thus the pressure may be alternatively written as a sum of cosine and sine terms, which are known as amplitude modes. In cases where the spectrum of S(θ) is Hermitian ($q_{-m}=q_m^{\,m}$), this can be written $$p_0(r, \phi, t) = e^{j\omega_0 t}\left[q_0 J_0(kr) + 2\sum_{m=1}^{\infty} j^m \mathrm{Re}\{q_m\}J_m(k_0 r)\cos(m\phi) - 2\sum_{m=1}^{\infty} j^m \mathrm{Im}\{q_m\}J_m(k_0 r)\sin(m\phi)\right] \tag{25}$$

The spectrum of the plane wave (equation 19) is Hermitian, and substituting for $q_m$ yields the simpler and well-known form $$p_0(r, \phi, t) = Ae^{j\omega_0 t}\left[J_0(kr) + 2\sum_{m=1}^{\infty} j^m J_m(k_0 r)\cos(m(\theta_0 - \phi))\right] \tag{26}$$

SUMMARY OF THE INVENTION

It is an object of the invention to provide an apparatus and/or method for use in recording sound fields. In general terms the invention is directed towards a transducer array and associated hardware for producing an audio signal which represents a desired sound field.

In one aspect the present invention may be said to consist of an apparatus for use in recording a sound field including: an array of transducer elements disposed in a substantially circular arrangement each of which produces an output signal in response to one or more incident sound waves from the field, a digital signal processor for calculating a Fourier transform of the output signals from the transducers to specify the sound waves as a plurality of components, one or more filters for equalising each component to flatten the apparent frequency response of the array over at least a portion of the audio band, and a network to combine the equalised components into an audio signal.

Preferably the microphones are cardioid microphones arranged to face radially outwards. Alternatively the microphones may be any type of omnidirectional or directional microphone.

Preferably the compensation network includes a Bessel function based compensation Function.

Preferably the output of the compensation network has an azimuthal angular response of the form $e^{\pm jm\theta}$ or cos (mθ) or sin (mθ) for m=0 to m=M, where M is the number of spherical harmonics calculated and θ is the angle of incidence defined from some reference angle.

In another aspect the present invention may be said to consist of an apparatus for producing audio signals representing a sound field including: a substantially circular array of omnidirectional microphones for receiving one or more sound waves from the field, a digital signal processor for calculating a Fourier transform of the microphone outputs at sample times, one or more filters for equalising each component of the Fourier transform, and a network for combining the equalised components into the audio signals.

In another aspect the present invention may be said to consist of an apparatus for producing an audio signal representing a sound source including: a circular array of cardioid microphones for receiving one or more sound waves from the source, a digital signal processor for calculating a Fourier transform from the microphone outputs at sample times, one or more filters for equalising each component of the Fourier transform, and a network for combining the components into a plurality of audio signals.

In another embodiment the present invention may be said to consist of a method for recording a sound source including: sampling sound waves from the source at a plurality of locations, and signal processing the samples to produce a plurality of audio signals representing the sound field, wherein the waves are sampled at locations which are arranged about a point.

Preferably the present invention provides a microphone array which can measure a plurality of spatial harmonics of a sound field in the horizontal plane, with polar responses that are substantially constant with frequency, and which avoid the difficulties that other microphones produce. The array processing is based on the Fourier transform combined with particular forms of frequency compensation, and yields circular phase and amplitude modes, which cannot be determined from existing systems.

In a possible embodiment spherical harmonics are produced by an array with N elements, up to a maximum number M=(N/2−1) for N even, and M=(N−1)/2 for N odd. An equalisation function is then used which extends the useable frequency response of the array over prior am arrays which use integrators. In this embodiment first order directional elements may be used in the array which eliminates zeros in the frequency responses of the array, further extending the frequency range over prior art systems. Such an embodiment can also simplify the construction process in comparison to existing microphone array apparatus.

BRIEF LIST OF FIGURES

A preferred form of apparatus and method of the invention will be further described with reference to the accompanying drawings by way of example only and without intending to be limiting, wherein.

DETAILED DESCRIPTION OF THE PREFERRED EMBODIMENTS

Figure 2:
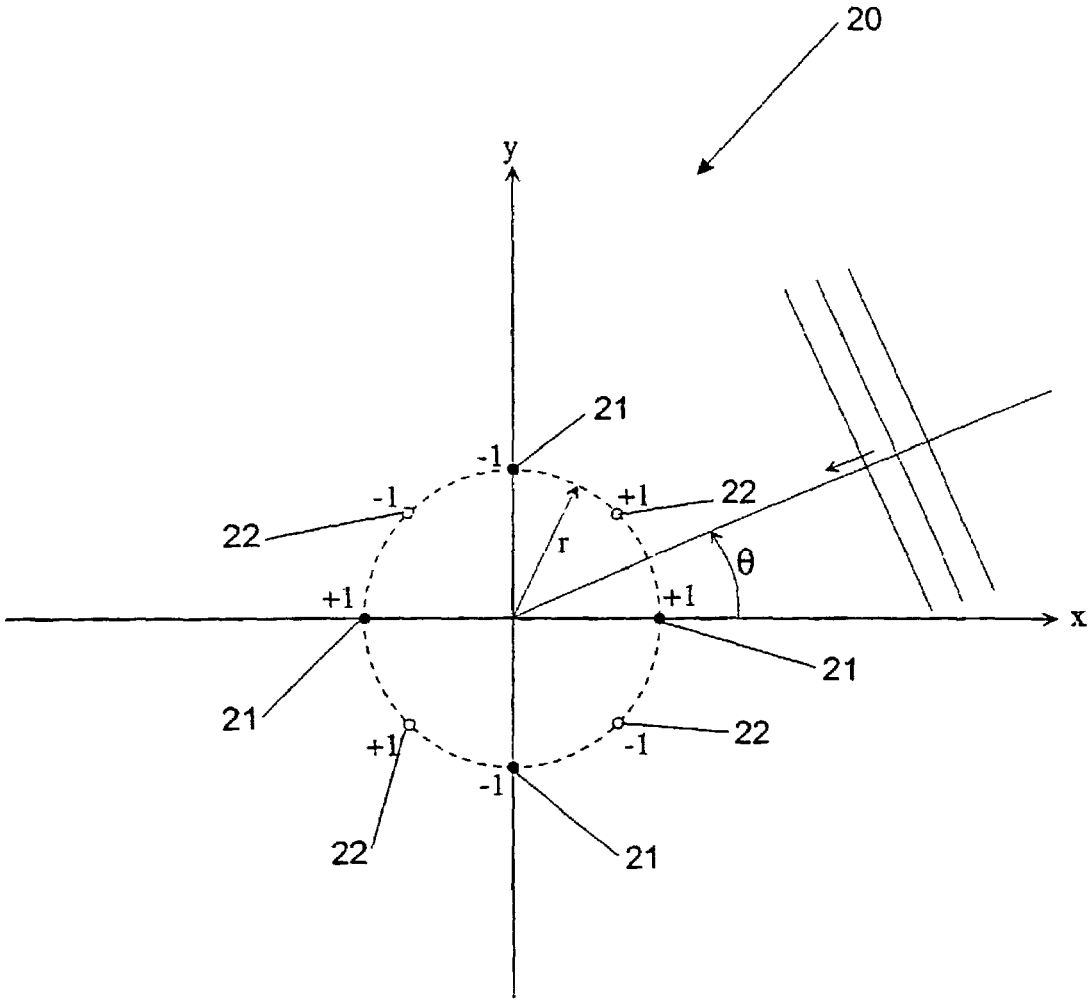
FIG. 2 shows prior art second order microphones based on two quadrapole arrays.

FIG. 2 shows an existing array 20 comprising two prior art second order microphones 21, 22 based on two quadrapole arrays. These microphones 21, 22 typically consist of two gradient elements—often each consisting of two pressure elements. The system produces the second spatial derivative with respect to one or two axes. The closed circles 1, 2, 3 and 4 represent the first second order microphone 21 and the open circles 5, 6, 7 and 8 represent the second second order microphone 22. The second order microphone 22 represented by the open circles produces a sin (2θ) polar response and the second order microphone 21 represented by the closed circles produces a cos (2θ) polar response. Together these two microphones 21, 22 produce the second spatial harmonic as described by the Fourier series when their outputs are combined as shown by the +1 and −1 beside each circle.

Figure 3A:
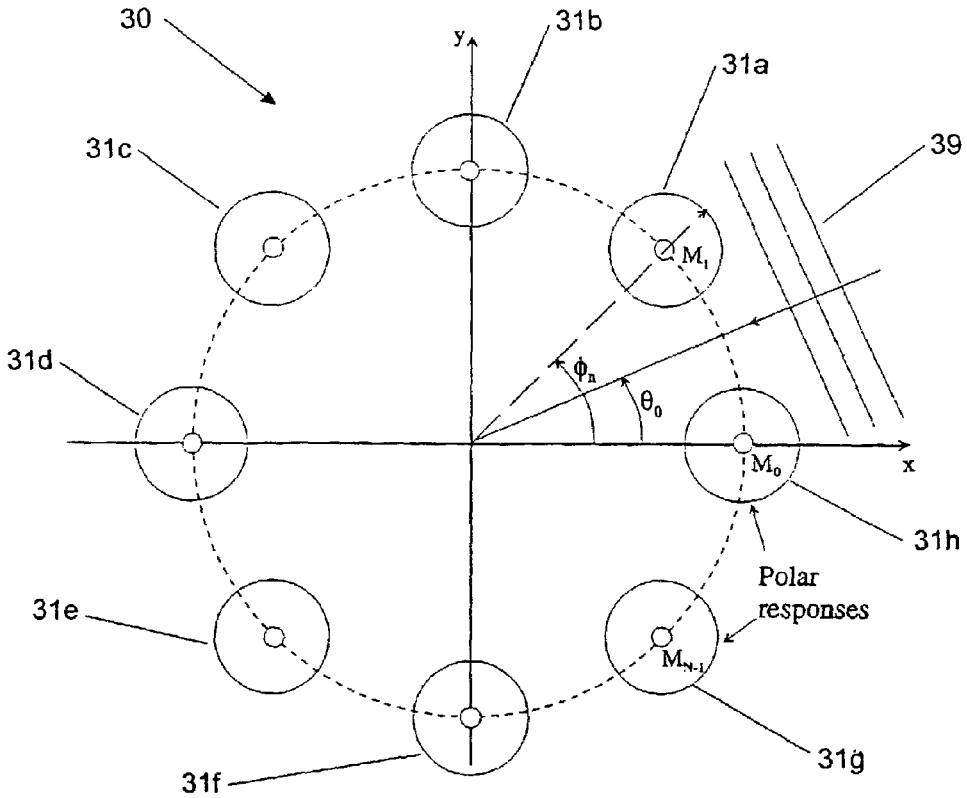
FIG. 3A shows a microphone array of omnidirectional microphones.
Figure 3B:
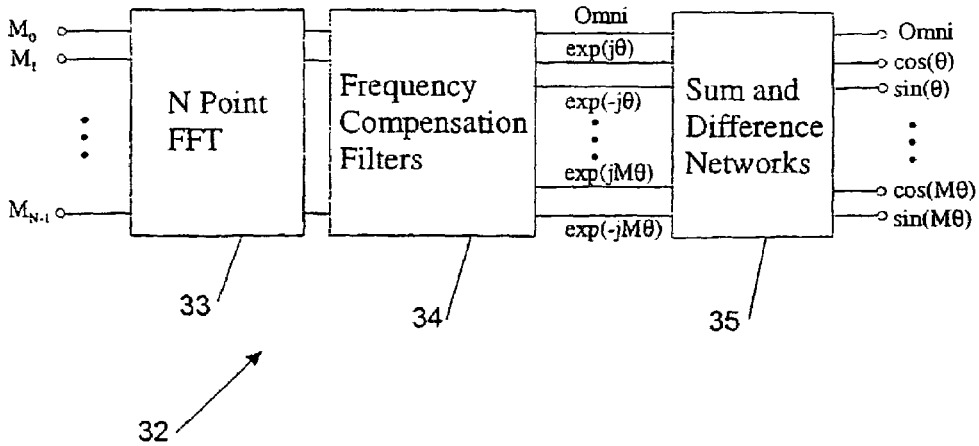
FIG. 3B is a block diagram illustrating the processing steps for the microphone outputs.

One embodiment of the invention 30, 32 shown in FIGS. 3*a* and 3*b* provides improved frequency response of a microphone array over existing arrangements. The background theory has shown that the sound pressure over a given region is equivalently described by the two dimensional source distribution S(k, θ)=P(k, θ, kc). Equation 22 provides a way to determine the spectral coefficients of $S_0(\theta)$ from p(r, ϕ,t). The pressure is itself a periodic function of ϕ, and therefore has Fourier coefficients $z_m$ given by $$z_m = \frac{1}{2\pi}\int_0^{2\pi} p(r, \phi, t)e^{-jm\phi}\,d\phi \tag{27}$$

Substituting from equation 22 yields $$\begin{aligned} z_m &= e^{j\omega_0 t}\sum_{l=-\infty}^{\infty} j^l J_l(k_0 r)q_l \frac{1}{2\pi}\int_0^{2\pi} e^{j(l-m)\phi}\,d\phi \\ &= e^{j\omega_0 t} j^m J_m(k_0 r)q_m \end{aligned} \tag{28}$$

by orthogonality of the phase modes, Hence $$q_m = \frac{e^{-j\omega_0 t}}{2\pi j^m J_m(k_0 r)} \int_0^{2\pi} p(r, \phi, t) e^{-jm\phi}\, d\phi \tag{29}$$

Thus the spectral coefficients of the source distribution may be obtained from the Fourier transform of the pressure on a circle, equalised by Bessel functions.

In practice, the recording is carried out using a discrete circular array of omnidirectional microphones, so that the pressure field is sampled. We now consider the effects of this sampling on the continuous case.

The sampling that occurs using a discrete array of microphones can be taken into account by multiplying the pressure p(r, ϕ,t) by a train of delta functions of the form $$\begin{aligned} g(\phi) &= \frac{2\pi}{N} \sum_{l=-\infty}^{\infty} \delta\left[\phi - \frac{l2\pi}{N}\right] \\ &= \sum_{l=-\infty}^{\infty} e^{jlN\phi} \end{aligned} \tag{30}$$

The second equivalent form will be useful for examining the aliasing caused by sampling.

The microphone array response $s_m(t)$ formed by substituting the delta function train into equation 27 is $$\begin{aligned} s_m(t) &= \frac{1}{2\pi} \int_0^{2\pi} p(r, \phi, t) e^{-jm\phi} \frac{2\pi}{N} \sum_{l=-\infty}^{\infty} \delta\left[\phi - \frac{l2\pi}{N}\right] d\phi \\ &= \frac{1}{N} \sum_{l=0}^{N-1} p\left(r, \frac{2\pi l}{N}, t\right) e^{-j\frac{2\pi ml}{N}} \end{aligned} \tag{31}$$

which is the DFT of the samples of the pressure at N equally spaced angles. If the second form of the sampling function is inserted, the result is $$\begin{aligned} s_m(t) &= \sum_{l=-\infty}^{\infty} \frac{1}{2\pi} \int_0^{2\pi} p(r, \phi, t) e^{-j[m-lN]\phi} \\ &= \sum_{l=-\infty}^{\infty} z_{m-lN} \end{aligned} \tag{32}$$

This form shows that the discrete array produces the sum of the [m−lN] phase modes obtained from the continuous integral (equation 27). The inth mode is the desired one and those for l≠0 are aliases, This equation is useful because it shows that the discrete array responses can be determined directly from the continuous integral in equation 27.

Substituting for $z_m$ from equation 28 and $q_m$ from equation 19 yields the response of the discrete array to a complex plane wave from direction $\theta_0$ $$s_m(t) = A e^{j\omega_0 t} \sum_{l=-\infty}^{\infty} j^{m-lN} J_{m-lN}(kr) e^{-j(m-lN)\theta_0} \tag{33}$$

This expression shows the alias phase modes explicitly, and may also be derived directly from the discrete sum in equation 31. For low frequencies or small radii, the l=0 term dominates, yielding the complex sinusoidal signal multiplied by the mth phase mode of the plane wave $$s_m(t) = A j^m J_m(kr) e^{j\omega_0 t} e^{-jm\theta_0} \tag{34}$$

However, at higher frequencies higher order aliases will begin to be significant, introducing unwanted sidelobes into the mth polar response. For cases where the aliases are small, the array output must be equalised by a function $$E_1(\omega) = \frac{1}{j^m J_m(kr)} \tag{35}$$

in order to produce a response which is constant with frequency. The equalisation may be carried out up to the frequency where $J_m(kr)$ is equal to zero. At this point the equalisation function is infinite. This marks the upper frequency limit of the array. The frequency range is therefore specified by the array radius r, with smaller radii allowing a wider frequency range.

Figure 1:
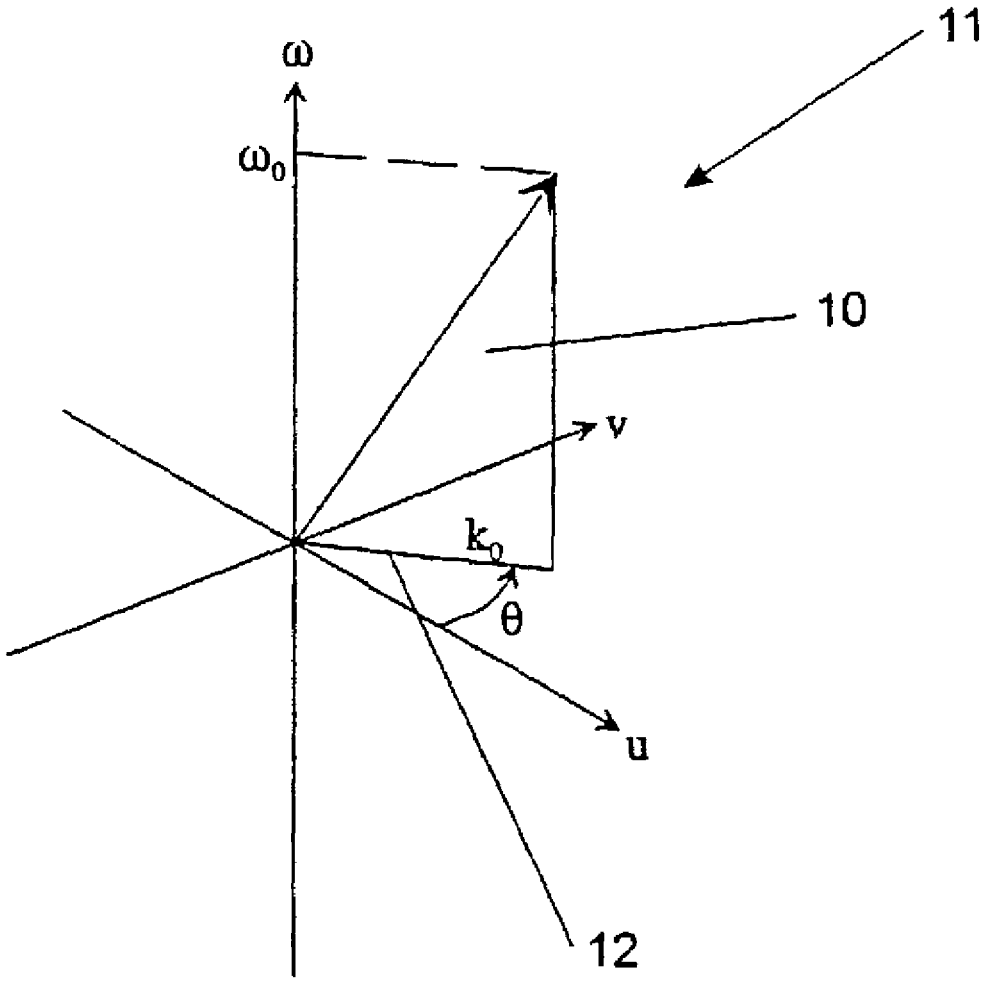
FIG. 1 shows a vector of a complex plane wave.

The circular array with DFT processing is a generalisation of the prior art quadrapole microphones 11, 12 shown in FIG. 1. This may be shown as follows: The amplitude mode responses for a plane wave input may be determined from equation 31

$$s_m(t) + s_{-m}(t) = \frac{2}{N} \sum_{l=0}^{N-1} p\left(r, \frac{2\pi l}{N}, t\right) \cos\left(\frac{2\pi lm}{N}\right) \tag{36}$$

and $$j[s_m(t) - s_{-m}(t)] = \frac{2}{N} \sum_{l=0}^{N-1} p\left(r, \frac{2\pi l}{N}, t\right) \sin\left(\frac{2\pi lm}{N}\right) \tag{37}$$

From equations 36 and 37 it is apparent that for N=8 and m=2 the cosine mode uses only the 0, 2, 4, 6, elements since cos (nπ/2) is zero for odd n. The signs for the non-zero elements are $(-1)^{n/2}$. Similarly the sine mode response is zero for the even elements and the signs are $(-1)^{(n-1)/2}$. The 8 element array with DFT weightings thus produces the same responses as the two quadrapole microphones in FIG. 1. Higher numbers of elements also produce circular arrays with amplitude weightings of ±1. For example an N=12 element array produces two hexagonal arrays with alternating sign weightings for m=3 and these two arrays produce cos (3θ) and sin (3θ) polar responses. In general, the DFT approach produces all circular multipole arrays for N=4m, but also allows the implementation of a greater number of responses using other numbers of microphones, and with complex amplitude weightings.

FIG. 3A shows a circular microphone array 30 of 8 omnidirectional microphones 31*a* to 31*h*. The microphones 31*a* to 31*h* are evenly spaced around a circle of uniform radius. These microphones receive sound from all directions equally and cannot individually distinguish the direction of origin of a sound wave. A sound wave 39 arrives at the microphone array at angle $\theta_0$. This sound wave is detected by all the microphones 31*a* to 31*h*. The outputs of the microphones are passed to an equalisation network. FIG. 3B shows the processing blocks 32 used to equalise the outputs of the microphones 31*a* to 31*h* to produce the best frequency response. The outputs of the microphones 31*a* to 31*h* are first processed in an N-point DFT block 33 before passing through a frequency compensation network 34 containing a Bessel function based equaliser function. Following this the signals pass through a sum and difference network 35 to produce amplitude node responses. The output of the sum and difference network 35 is in terms of the spatial harmonics of the microphones 31*a* to 31*h*.

The DFT block 33, frequency compensation network 34 and sum and difference network 35 may be readily implemented by those skilled in the art based on the explanations of the nature of the array disclosed in this specification. The frequency compensation network 34 may utilise FIR or IIR filters.

The DFT array 30 allows a number of harmonics to be measured from a single array, up to (in principle) the positive Nyquist value $$M = \begin{cases} \frac{N}{2} - 1 & N \text{ even} \\ \frac{N-1}{2} & N \text{ odd} \end{cases} \tag{38}$$

Figure 4:
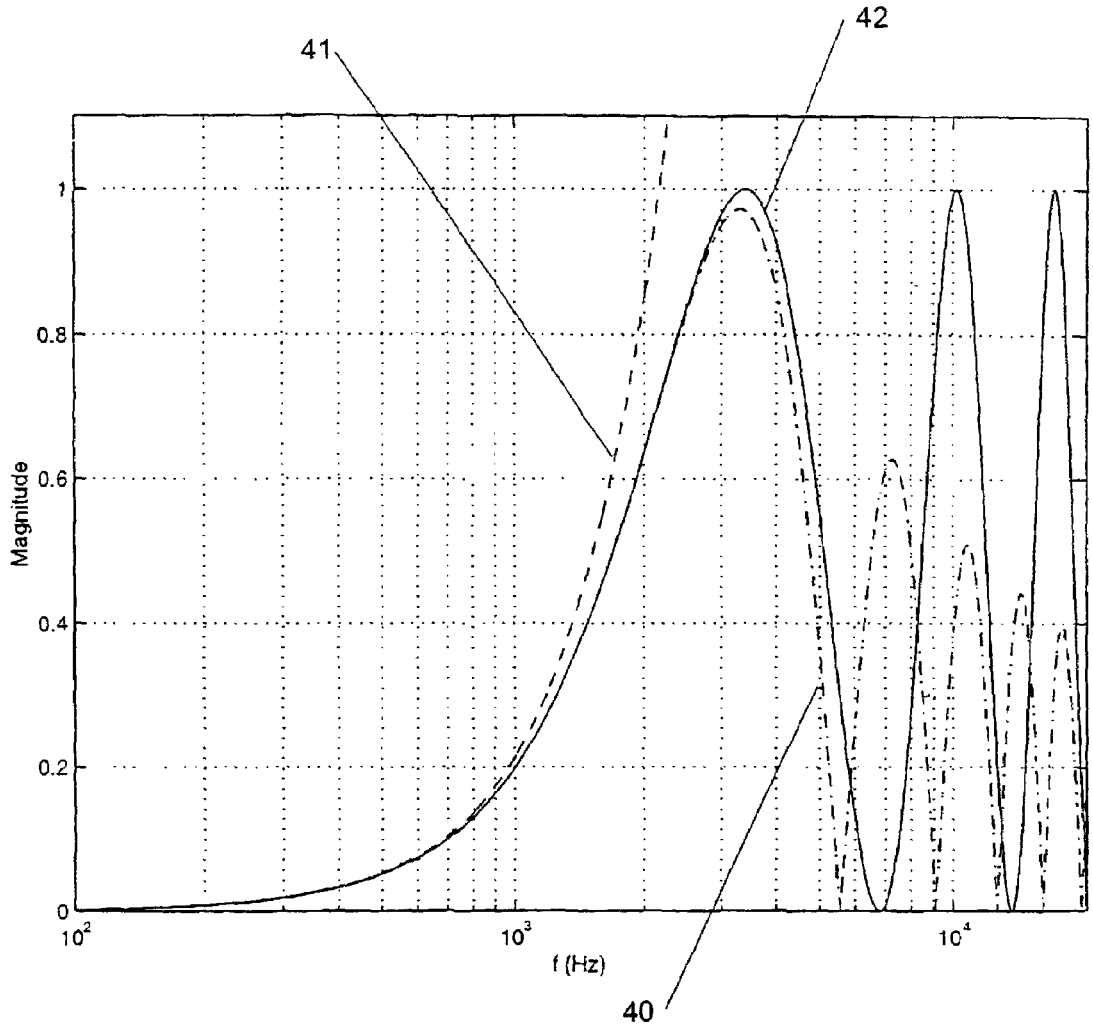
FIG. 4 is a graph of the cosine response of a prior art quadrapole microphone.

FIG. 4 shows as a solid line the unequalised cosine response 42 of the prior art quadrapole with cos (2θ) polar response, for a plane wave field arriving from θ=0 degrees and an array radius of 50 mm. The lowest order response 40 (equation 34) is shown dash-dotted. The lowest order response 40 is equal to the actual output of the discrete array up to about 3 kHz, above which the first alias term begins to be significant. The response 41 of a second order differentiator is shown dashed. This is the response that would be perfectly equalised by a prior art second order integrator, and is the low frequency approximation to the Bessel function. At low frequencies (less than about 1 kHz) the integrator will produce a constant output with frequency, but at higher frequencies the integrator output will begin to reduce. Using the lowest order Bessel function equalisation extends the quadrapole response up to 3 kHz, and including the first alias will further extend the frequency range. At 6.8 kHz, the array output is zero, and equalisation is not possible, and so the upper frequency limit is in the region of 6 kHz. Using a smaller array radius will produce a higher frequency limit, but the low frequency equalisation gain will become larger. This is the classical trade-off in microphone design that typically requires the microphone elements to be close together to produce a wide frequency range, or the use of two-way designs.

Figure 5:
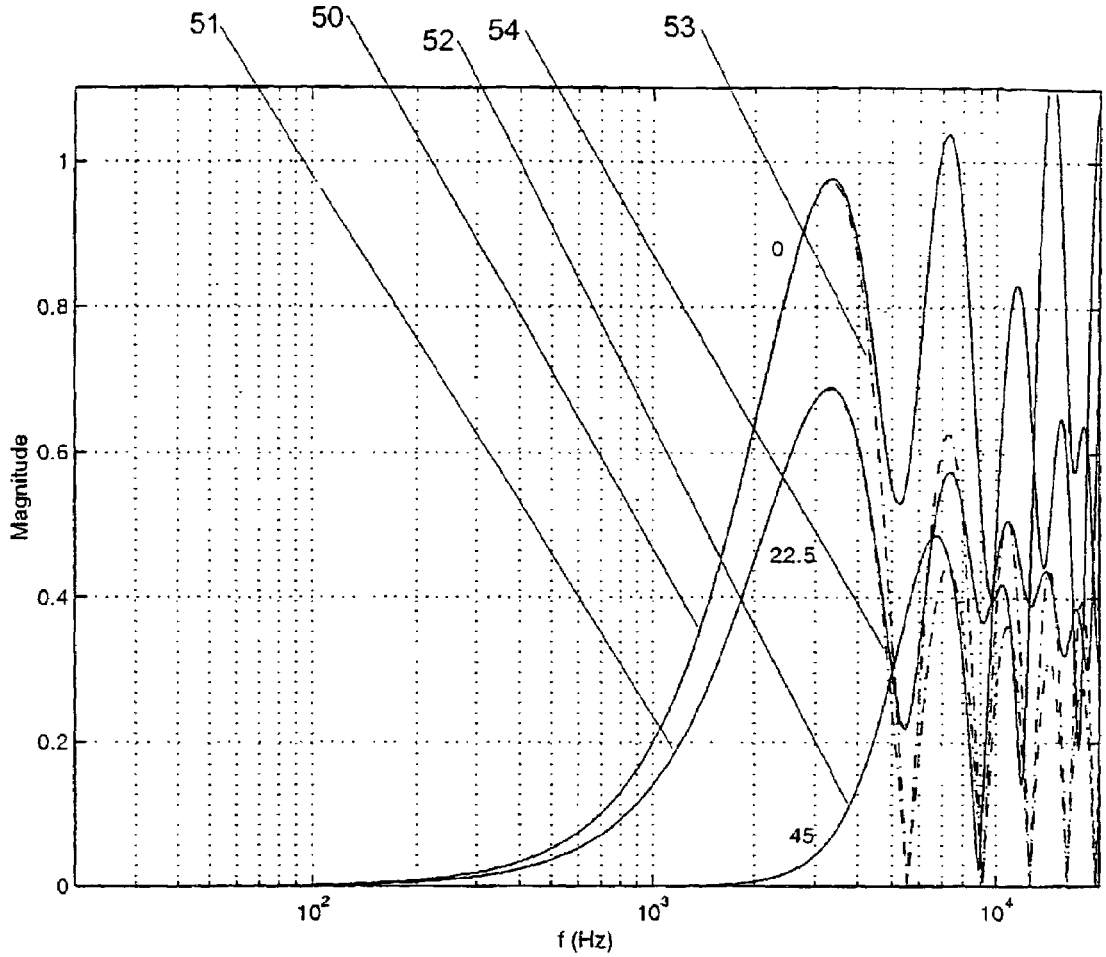
FIG. 5 is a graph of the cosine response of a second order DFT microphone.

FIG. 5 shows as solid lines the unequalised frequency responses 50, 51, 52 of the second cosine amplitude mode produced by a DFT array with N=7 elements arranged at a radius of 50 mm for input angles 0, 22.5 and 45 respectively. The lowest order responses 53, 54 that would be obtained using a continuous array are shown dash-dotted for each angle, The ideal response is zero for 45 degrees but the actual responses 50, 51, 52 rise above 2 kHz due to the higher order aliases.

Figure 6:
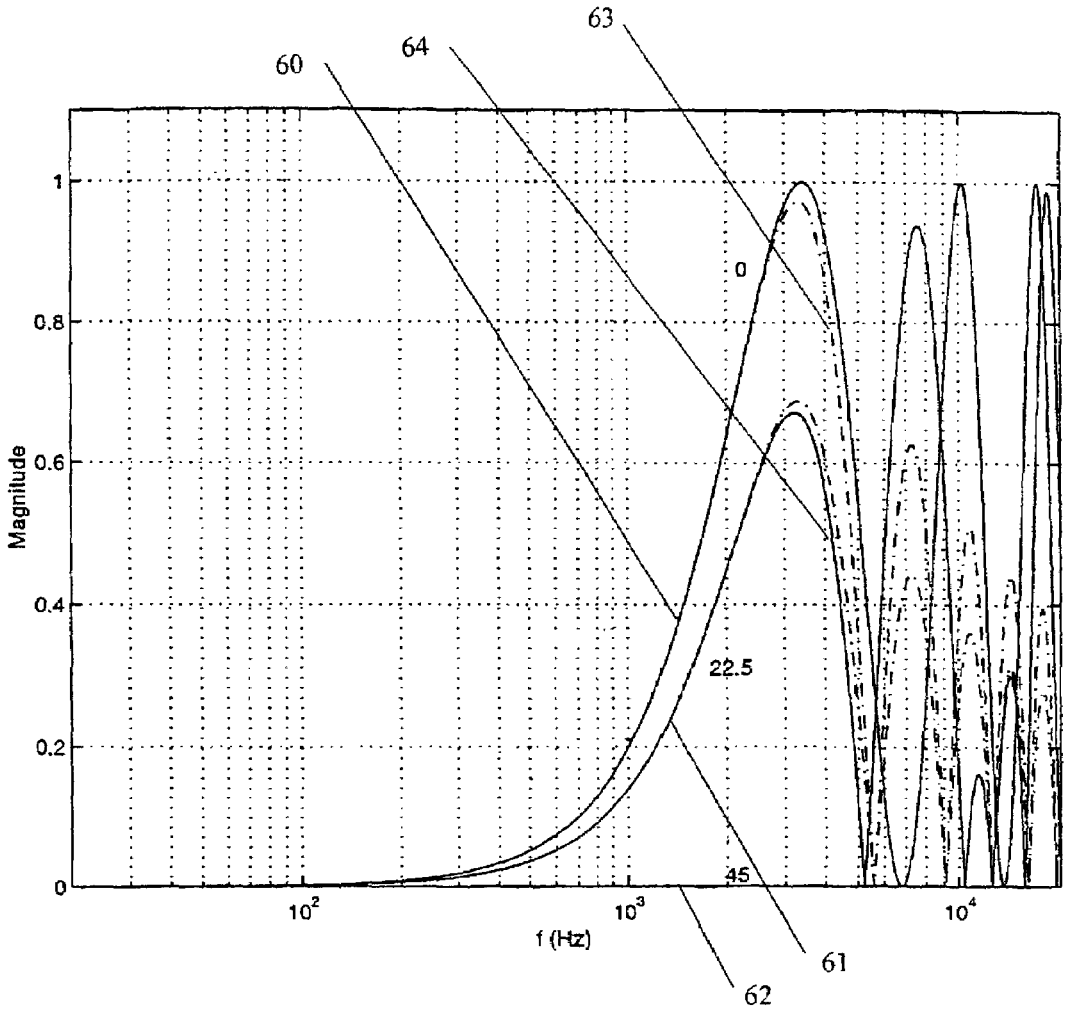
FIG. 6 is a graph of the cosine response of a second order DFT microphone.

FIG. 6 shows as solid lines the unequalised second order cosine responses 60, 61, 62 of an N=8 DFT array with a radius of 50 mm and input angles 0, 22.5 and 45 respectively. The lower order responses 63, 64, 65 are shown in as a dash dotted line. It has the same form as the quadrapole response in FIG. 4, as expected. The N=7 (of FIG. 5) responses are closer to the lowest order responses than the N=8 responses, possibly because they use all the microphone elements, but the 45 degree response is not zero as it is for the N=8 case. However, the actual 0 (60) and 22.5 (61) degree responses in FIG. 6 produce zeroes at higher frequencies, making equalisation impossible above around 5 kHz for θ=22.5 degrees and around 6.5 kHz for 0 degrees.

Figure 7:
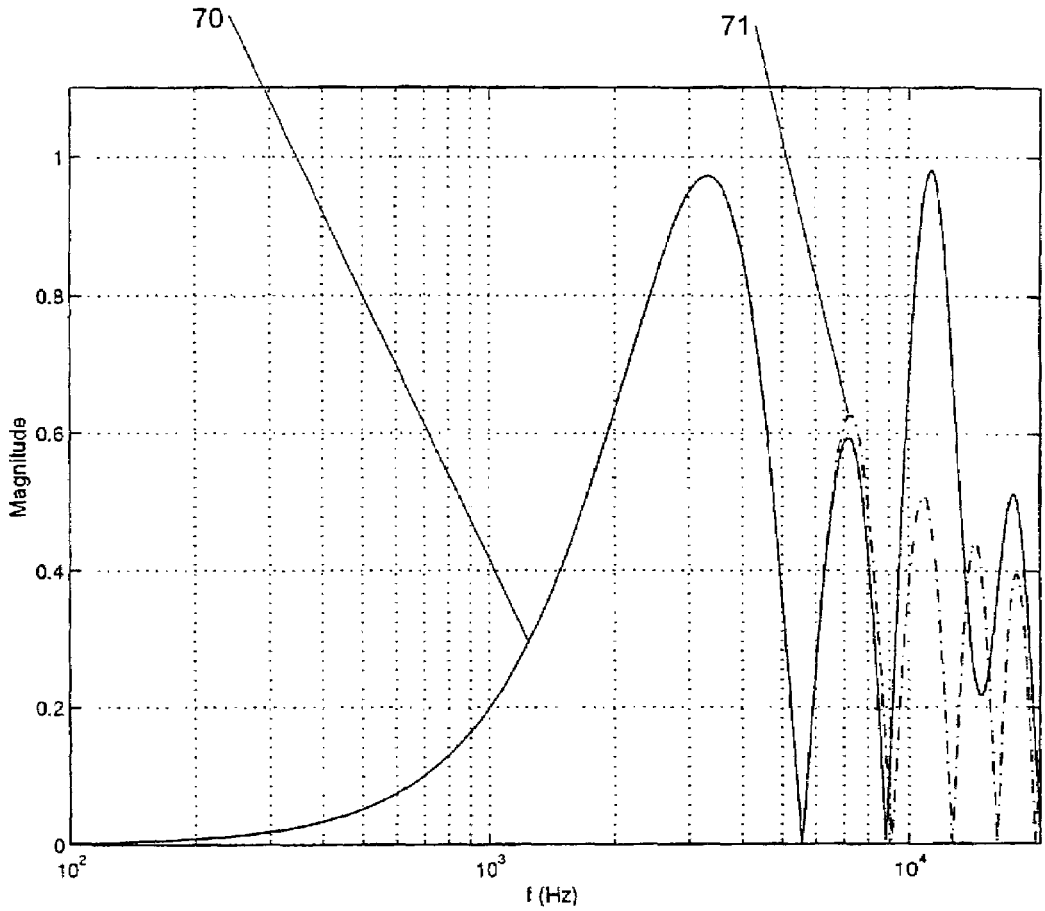
FIG. 7 is a graph of the cosine response of a second order DFT microphone.

An important advantage of the DFT approach is that if a higher number of microphone elements are used, the aliasing terms are pushed higher in frequency. This is a well known property of sampling theory. It is demonstrated in equation 33, which shows that the next two higher Bessel functions after the mnth have orders N−m and N+m. Thus, for m=2 and N=8 the first alias has order 6 and the second has order 10. Using N>8, however, results in reduced aliasing. For example, with N=12 microphones, the first alias magnitudes are $J_{10}(kr)$ and $J_{14}(kr)$. The cosine amplitude mode response 70 with 12 elements is shown in FIG. 7 with θ=0 degrees and a 50 mm array radius. The lowest order response 71 is identical to that of the quadrapole response in FIG. 4, but the actual response is now equal to the lowest order response 71 up to about 7 kHz, as opposed to only 3 kHz for the zero degree response in FIG. 6. This shows that the higher order aliases are less significant, Thus, for sufficiently large numbers of array elements, equation 35 is the correct equalisation function over the entire useable frequency range.

The analysis above assumes a complex plane wave input. In practice the sound pressure is a real function, and each positive frequency is associated with a negative counterpart.

The DFT array response is thus the sum of the positive and negative frequency responses. Putting k=−k in equation 35 and noting that $J_m(-z)=(-1)^m J_m(z)$ shows that the equalisation filter response for the negative frequency is the conjugate of the positive frequency value. Hence the equalisation filter transfer function is Hermitian and the impulse response is therefore real. The processing for real pressure signals is therefore unchanged. The DFT processor produces complex outputs for each phase mode, ie two signals representing the real and imaginary components. Both components are then filtered by the real equalisation filter to produce frequency independence. The complex phase mode signals may then be combined to produce real amplitude mode outputs.

Figure 8A:
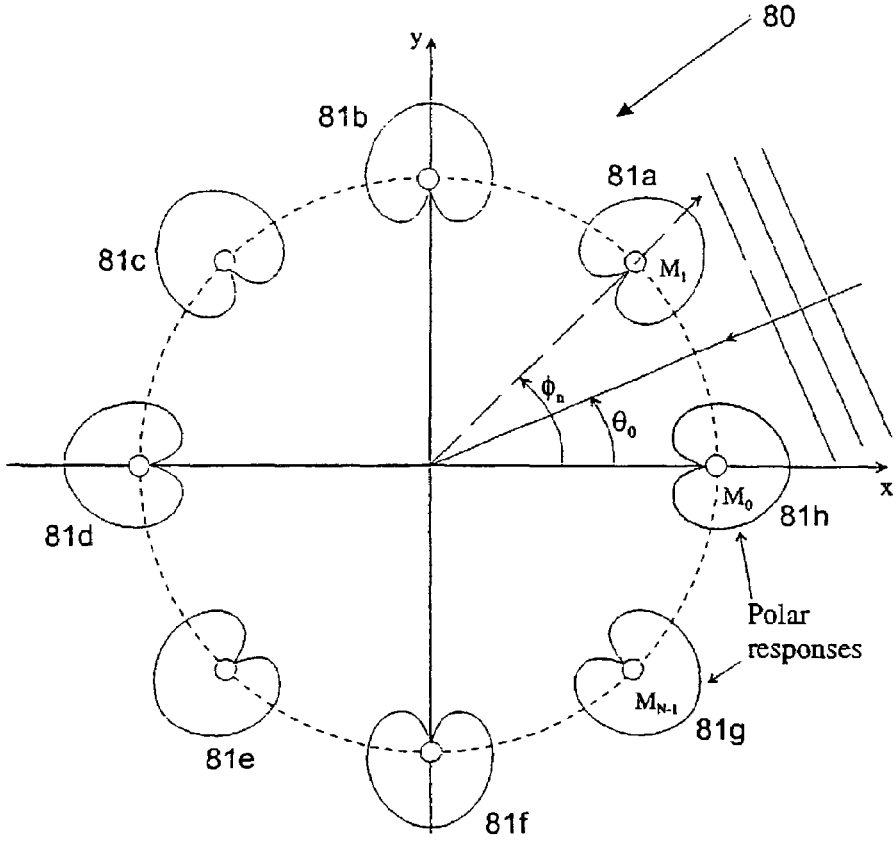
FIG. 8A shows a circular microphone array of cardioid microphones.
Figure 8B:
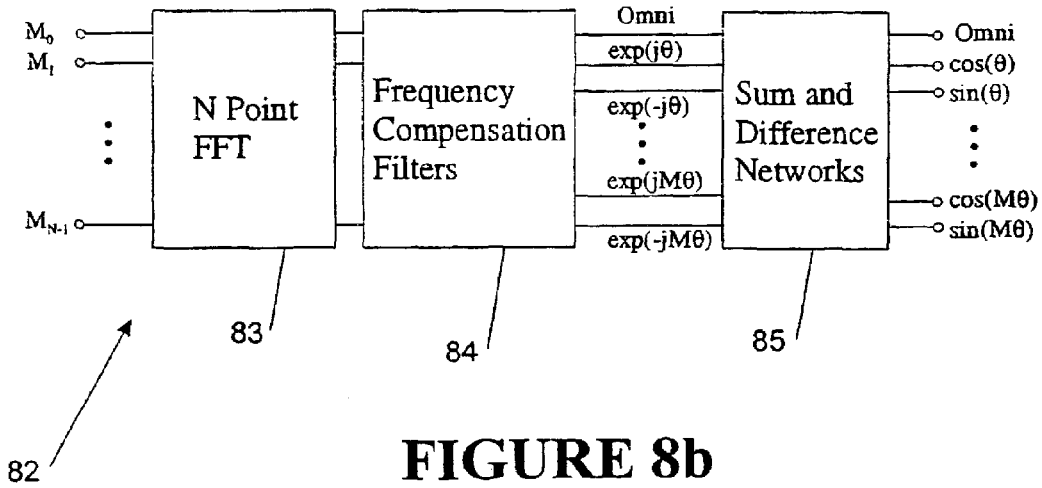
FIG. 8B is a block diagram illustrating the processing steps for the microphone outputs.

Another, preferred, embodiment of the invention is shown in FIGS. 8*a* and 8*b* which also provides an apparatus with improved frequency response. The microphone arrays discussed so far produce zeros in the frequency response where equalisation is not possible. However, this problem may be avoided by constructing an array 80 using first order directional microphone 81*a*–81*h*. The output from the array 80 can be equalised using signal processing hardware 82 comprising a DFT 83, frequency compensation filters 84 and a sum and difference network 84. Each directional microphone element 81*a*–81*h* has a response:

$$p_n(\theta)=\alpha+(1-\alpha)\cos(\theta-\theta_n) \tag{39}$$

Each microphone element 81*a* to 81*h* has its main lobe "looking outward" (radially) from the array centre, as shown in FIG. 8*a*, The first order microphone consists of the combination of a pressure and velocity response, and so the array response may be determined as the sum of the pressure response for a complex plane wave, determined in the previous section (equation 28), and the velocity response $$z_{m,0}(t) = \frac{A}{2\pi}\int_0^{2\pi} e^{j[\omega_0 t + kr\cos(\phi-\theta) - jm\phi}\cos(\phi-\theta)\,d\phi \tag{40}$$

Applying the sampling function to this integral again shows that the discrete array response consists of a sum of the m=lN phase mode responses. Therefore we need consider only the continuous integral The l=0 velocity response is found using $$\frac{d}{dz}J_m(z) = \frac{j}{2\pi}\int_{-\pi}^{\pi t} e^{-jt\theta + jz\cos(\theta)}\cos(\theta)\,d\theta \tag{41}$$

and is $$z_{m,0}(t) = Ae^{j\omega_0 t} j^{m-l} J'_m(kr)e^{-jm\theta} \tag{42}$$

where $J'_m(kr)$is the derivative of $J_m(kr)$, and hence the array responses using N outward-facing velocity microphones are $$s_{m,0}(t) = Ae^{j\omega_0 t} j^{-1}\sum_{l=-\infty}^{\infty} j^{m-lN} J'_{m-lN}(kr)e^{-j(m-lN)\theta} \tag{43}$$

Adding the pressure (33) and velocity (43) responses according to (39) yields $$s_{m,\alpha}(t) = Ae^{j\omega_0 t}\sum_{l=-\infty}^{\infty} j^{m-lN}[\alpha J_{m-lN}(kr) - j(1-\alpha)J'_{m-lN}(kr)]e^{-j(m-lN)\theta} \tag{44}$$

The ideal first order element responses (l=0) are thus $$z_{m,\alpha}(t) = Ae^{j\omega_0 t} j^m[\alpha J_m(kr) - j(1-\alpha)J'_m(kr)]e^{-jm\theta} \tag{45}$$

which requires the equalisation function $$E_\alpha(\omega) = \frac{j^{-m}}{\alpha J_m(kr) - j(1-\alpha)J'_m(kr)} \tag{46}$$

In practice the derivative of the Bessel function may be determined from the identity $$J'_m(z) = \frac{J_{m-1}(z) - J_{m+1}(z)}{2} \tag{47}$$

Equation 46 shows that the problems with the zeros of $J_m(kr)$ are removed. Since the derivative of the Bessel function is zero at different points, the sum of the two is non-zero for all frequencies. However, the actual array response (including aliases) only produces non-zero magnitudes for suitably large N.

Figure 9:
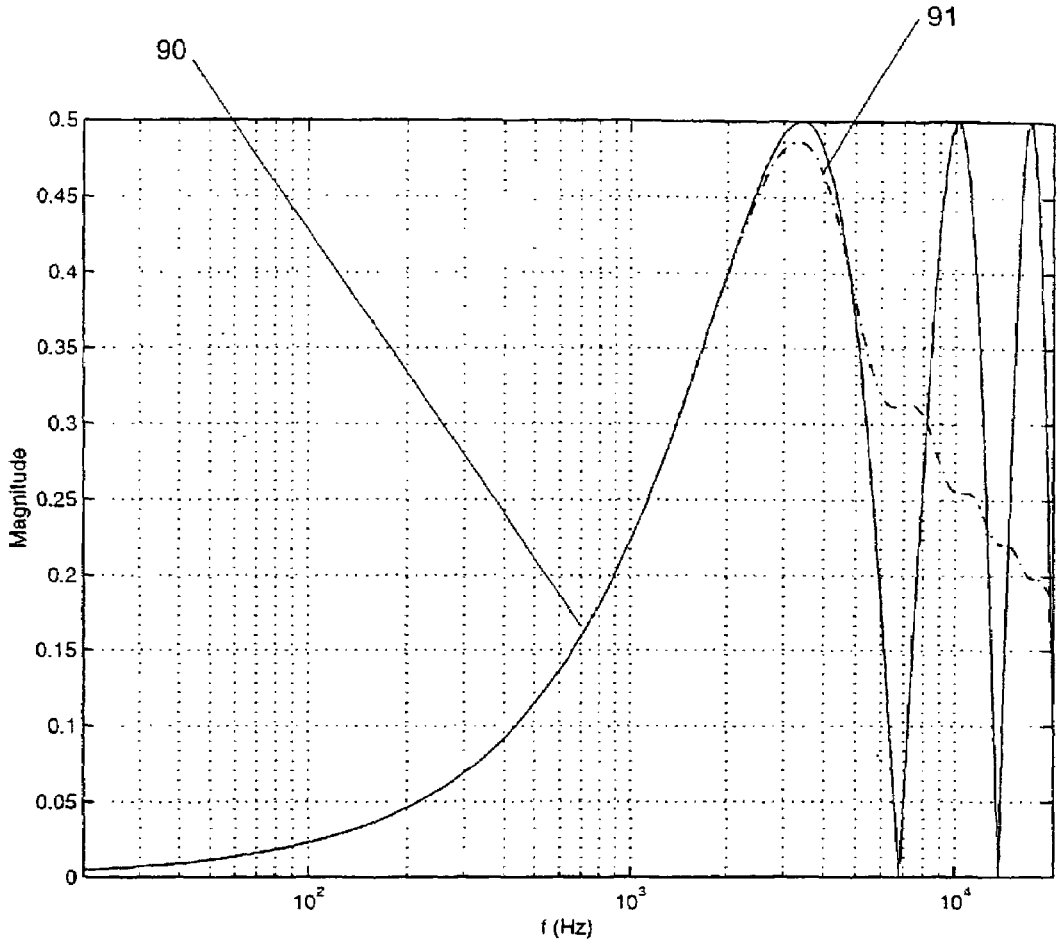
FIG. 9 is a graph of the cosine response of a quadrapole microphone array using cardioid microphones.
Figure 10:
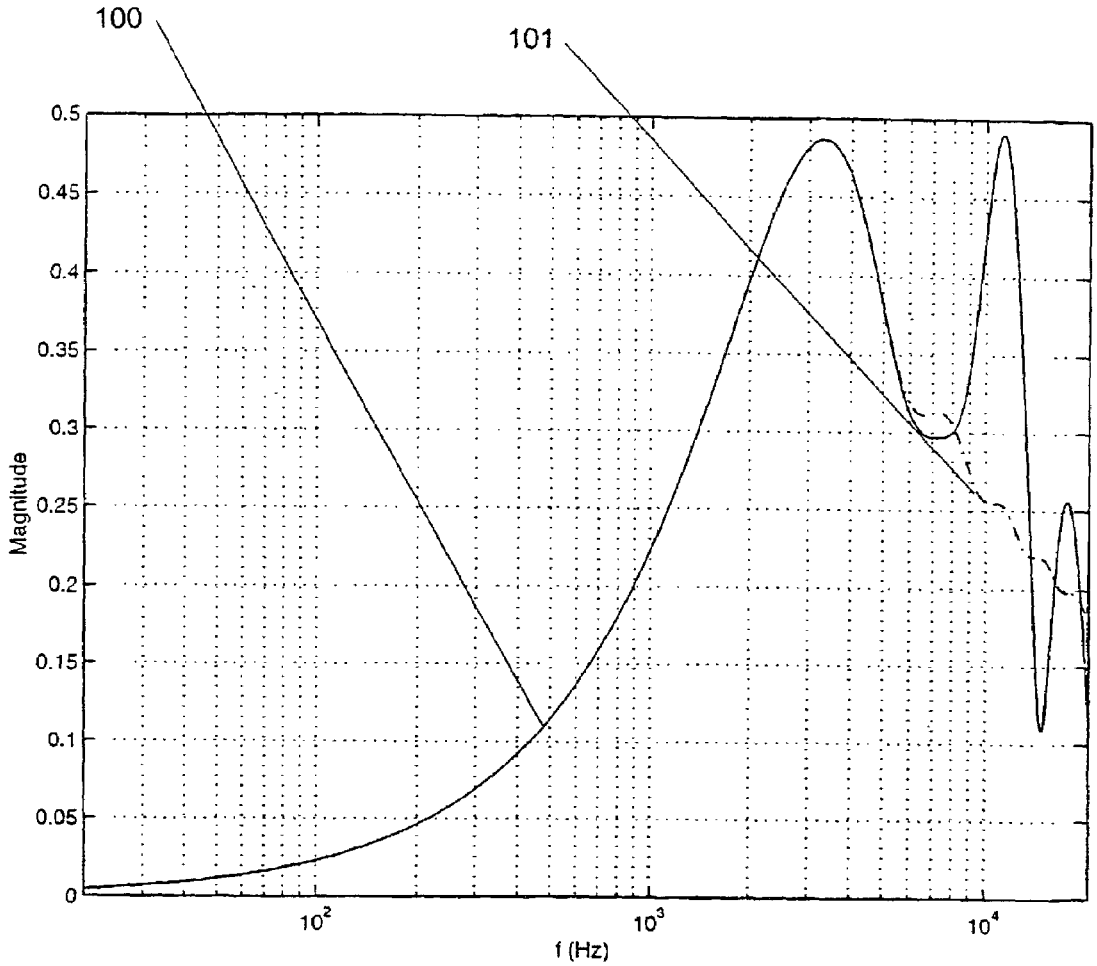
FIG. 10 is a graph of the cosine response of a second order DFT microphone array using cardioid microphones.

The unequalised response 90 of a cardioid array of radius 50 mm with N=8 elements (the quadrapole case), α=0.5 (cardioid) and θ=0 degrees is shown in FIG. 9 The lowest order response 91 has no zeros, but the discrete array still produces zeros in its response. The cosine amplitude response 100 magnitude for N=12 cardioid array of radius 50 mm with α=0.5 (cardioid) and θ=0 degrees is shown in FIG. 10. The actual response now follows the lowest order response 101 up to a frequency of about 6 kHz as opposed to 3 kHz for the quadrapole. More importantly, the reduction of aliases has produced a response with no zeros. This means that the frequency compensation can be carried out over a wide bandwidth with no difficulty. The cardioid element produces the lowest variation in frequency response. This is because each element has its null pointed at the opposite side of the array, which minimises comb filtering caused by wavefronts crossing from one side of the array to the other.

Figure 11:
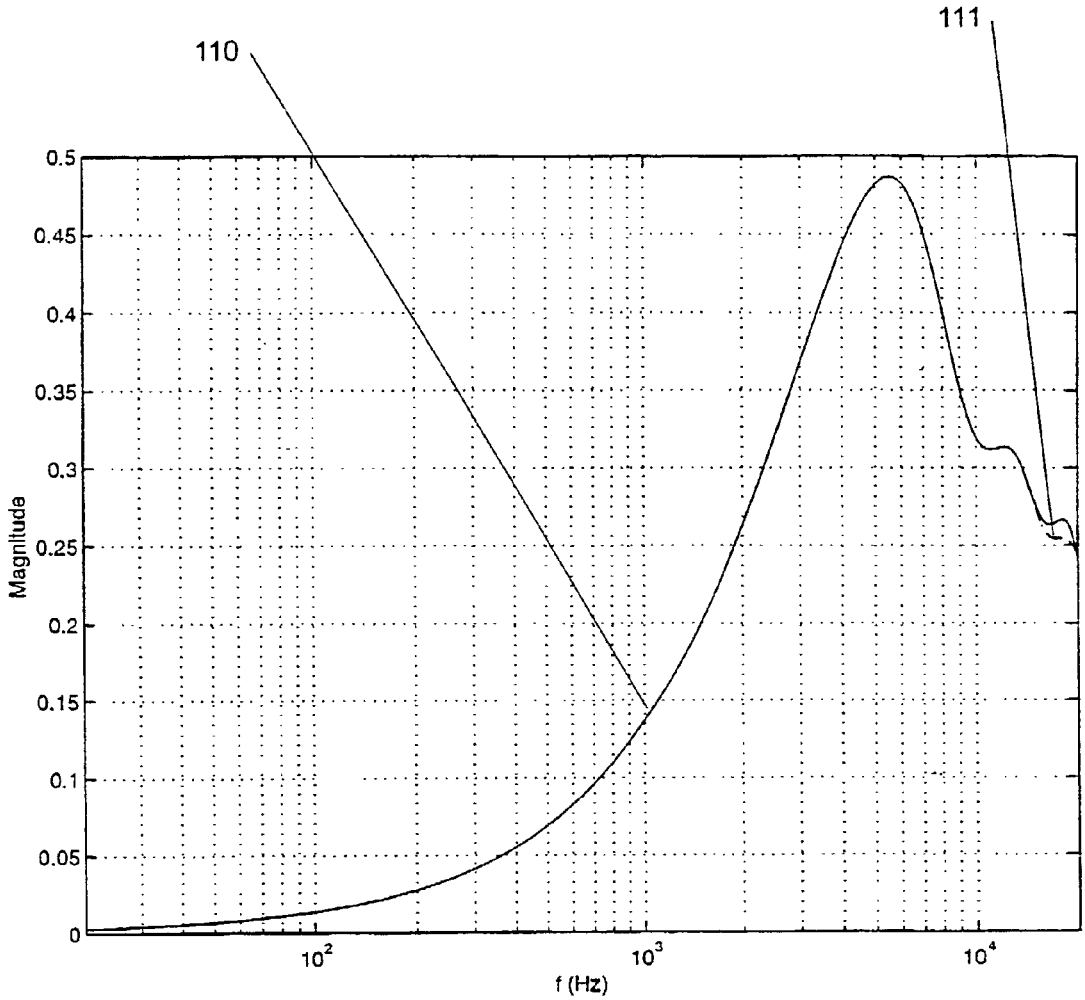
FIG. 11 is a graph of the cosine response of a second order DFT microphone array using cardioid microphones.
Figure 12:
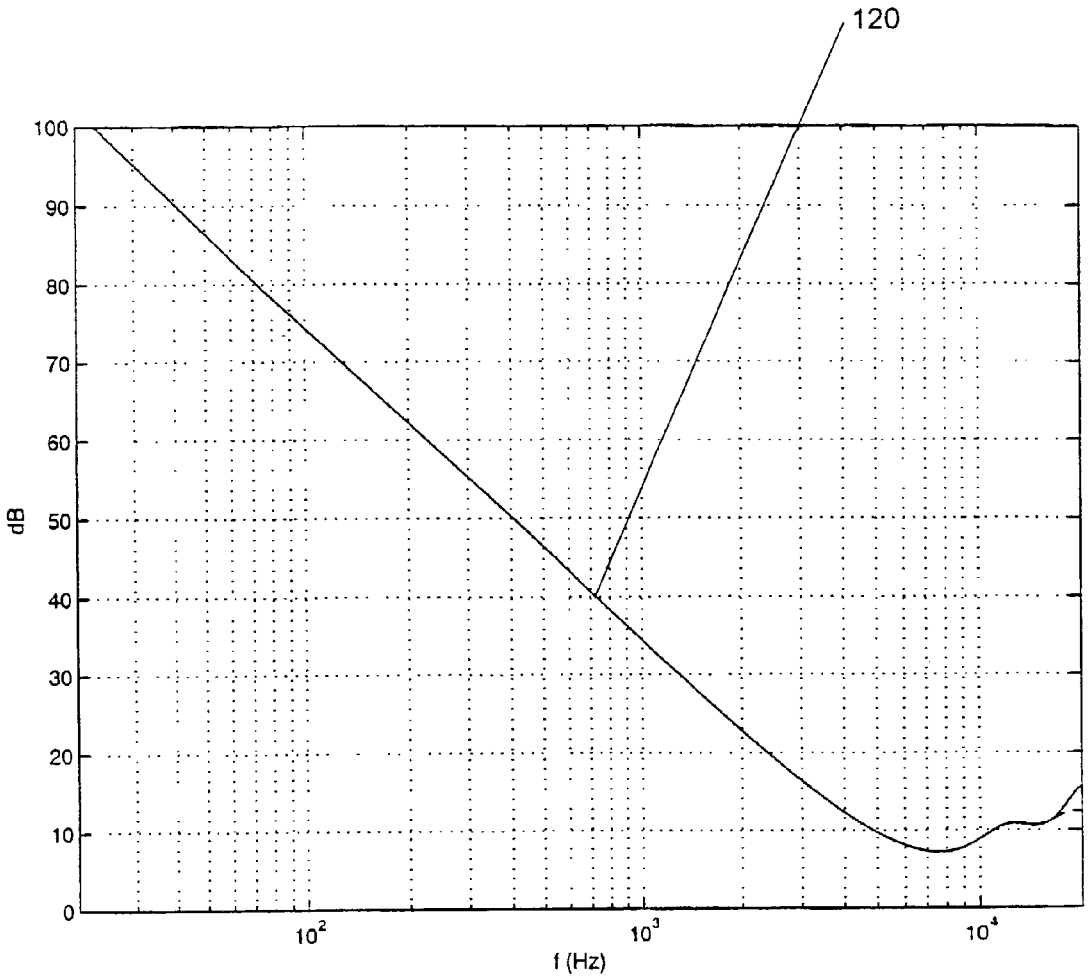
FIG. 12 is a graph of the required compensation for a second order DFT cardioid microphone system.

As a more practical example, consider an array of 16 cardioid elements with radius 30 mm. The uncompensated cosine response 110 for an input angle of zero degrees is shown in FIG. 11 along with the low order response 111 and the required magnitude compensation 120 in FIG. 12. The DFT array response is non-zero over the entire audio bandwidth, and this is true for all angles, with a cos (2θ) weighting of the response. Furthermore, the compensation gain variation is considerably less than would be required for a prior art quadrapole using two integrators. This is because the mth harmonic response using directional elements introduces a Bessel function of order m−l (equation 47), which has a greater amplitude at low frequencies. A double integrator reduces by 40 dB per decade, requiring 120 dB gain variation from 20 Hz to 20 kHz. The example in FIG. 12 demonstrates only 45 dB variation, reducing low frequency noise problems.

Figure 13:
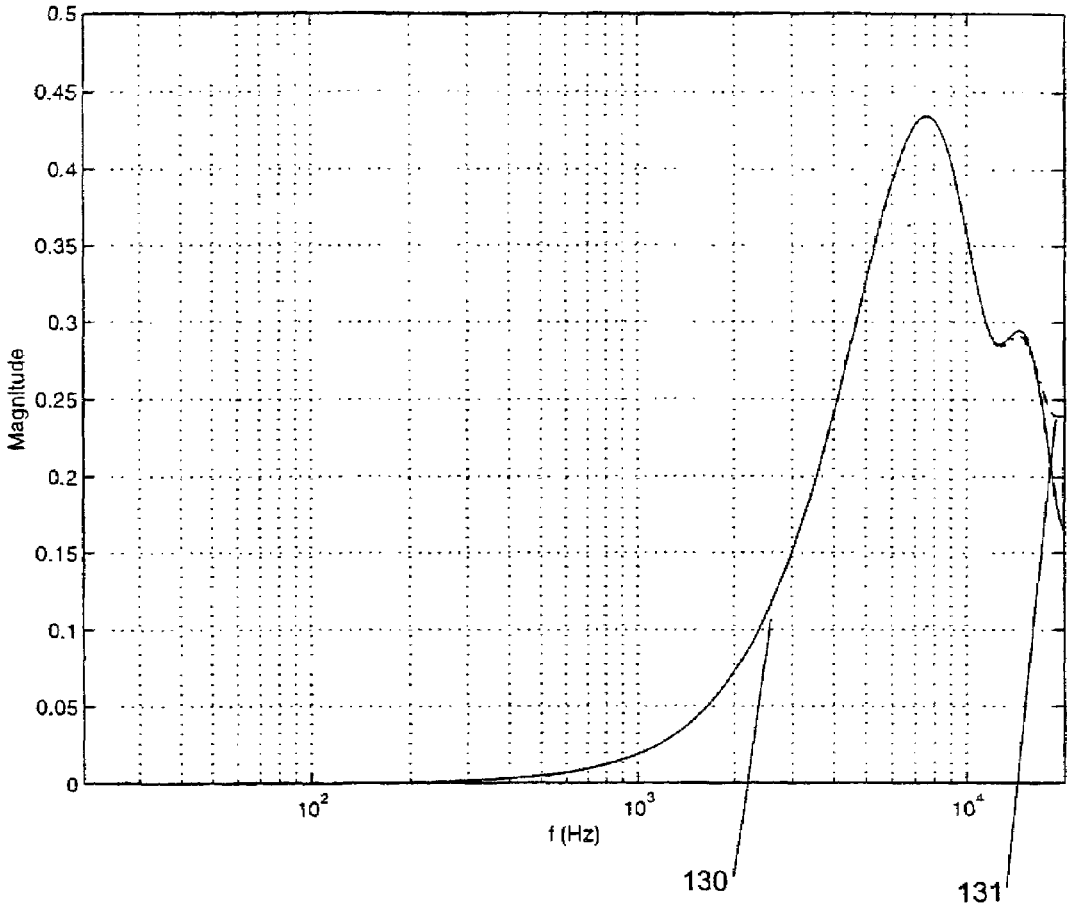
FIG. 13 is a graph of the cosine response of a third order DFT microphone array with cardioid elements.
Figure 14:
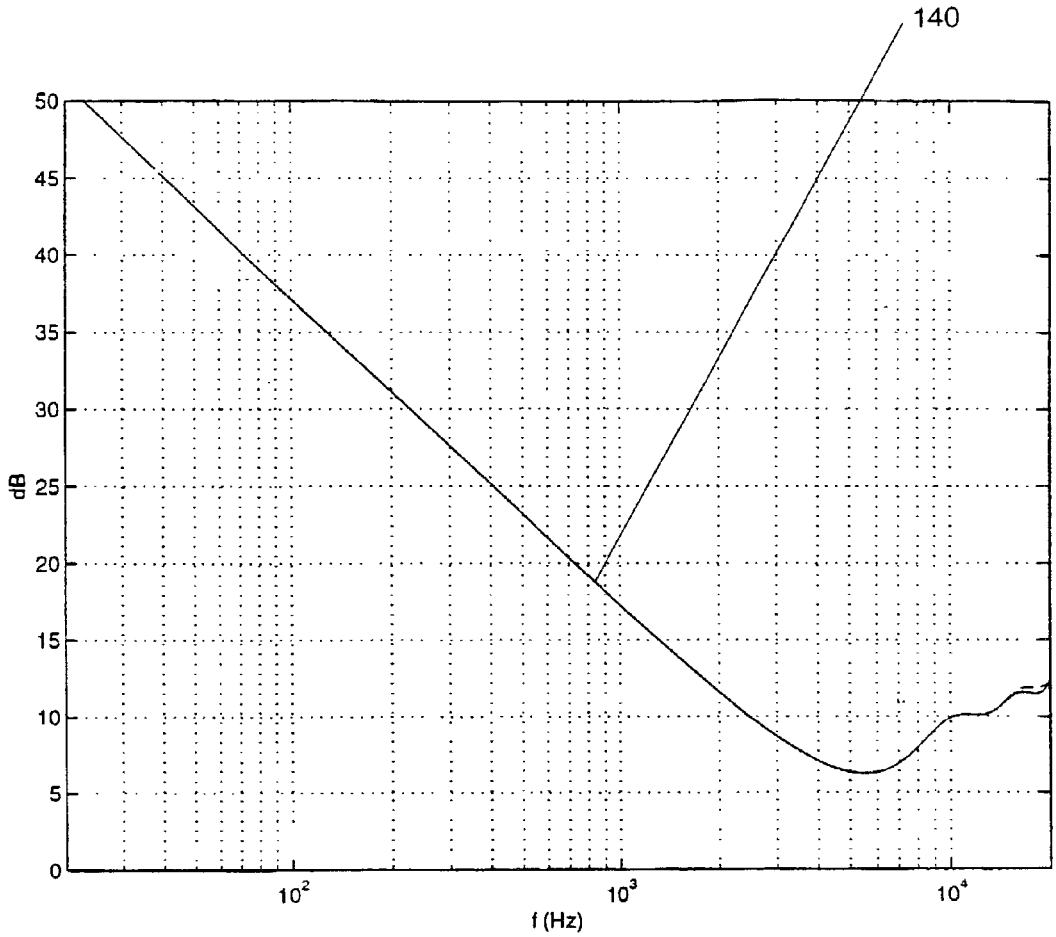
FIG. 14 is the required compensation for the third order DFT microphone array.

Finally, the third order uncompensated cosine response 130 for N=16, R=30 mm input angle of zero degrees along with the low order response 131 is shown in FIG. 13 and the required compensation gain 140 in FIG. 14. The response is still well-behaved, and the gain variation is now around 95 dB, which is less than the 180 dB which would be required for a closely spaced six element multipole using three integrators.

The frequency magnitude and phase compensation of the DFT responses produces—ideally—flat responses with linear phase. The compensation filters are inverse filters that compress the dispersive impulse responses produced by the array and DFT processing back to the ideal impulse response, retaining the required angle dependence of the amplitude. This means that coincident microphones are not required. Surround sound recordings may thus be made using standard, high quality directional microphones and FFT and digital filter post-processing techniques.

Finally, a circular array may also be useful in areas of application other than surround sound systems, such as teleconferencing systems. Surround reproduction may be carried out using techniques such as ambisonics. Even if other reproduction methods are used, the circular microphone array is still useful for discriminating between speakers over 360 degrees. The directivity of a circular array is not as high as that of a linear array, which—for similar inter-element spacings—has an aperture of about π times that of the circular array. However, the circular array offers beam patterns that can be rotated around 360 degrees without the variable beam widths that occur in linear arrays, and may be placed for example in the centre of a table. Furthermore, since the amplitude mode responses are independent of frequency, the circular array can provide beam patterns that arc constant with frequency, avoiding the high frequency roll-off that can occur with standard linear arrays.

The descriptions given herein are not intended to be restrictive, and other implementations or examples of the generic forms derived will be understood by those skilled in the art.

The invention claimed is:

1. An apparatus for use in recording a sound field including: an array of transducer elements disposed in a substantially planar circular arrangement each of which produces an output signal in response to one or more incident sound waves from the field, a digital signal processor for calculating a Fourier transform of the output signals from the transducers to specify the sound waves as a plurality of components, one or more filters for equalising each component to flatten the apparent frequency response of the array over at least a portion of the audio band, and a network to combine the equalised components into an audio signal.

2. An apparatus according to claim 1 wherein the components are spherical harmonics of the sound field.

3. An apparatus according to claim 2 wherein the one or more filters equalise the components using a function based on one or more Bessel functions and/or derivatives of Bessel functions.

4. An apparatus according to claim 3 wherein the array is a substantially circular arrangement of substantially equally spaced transducers.

5. An apparatus according to claim 4 wherein the Fourier transform of the output signals is calculated with respect to angular displacement around the array to provide the plurality of components which represent the angle dependent sound field incident on the array at an instant in time.

6. An apparatus according to claim 4 wherein the Bessel functions are selected based on components which contribute significantly to the magnitude of the sound wave.

7. An apparatus according to claim 6 wherein the portion of the audio band over which the Bessel functions and/or derivatives equalise the apparent frequency response is extended by reducing the significance of higher order components.

8. An apparatus according to claim 7 wherein the significance of higher order components is reduced by increasing the number of transducers comprising the array.

9. An apparatus according to claim 4 wherein the significance of higher order components is reduced by reducing the radius of the array.

10. An apparatus according to claim 9 wherein the portion of the audio band over which the frequency response is flattened is extended to substantially the entire audio band by using transducers which are first order microphones.

11. An apparatus according to claim 1 wherein each transducer is an omnidirectional microphone.

12. An apparatus according to claim 1 wherein each transducer is a cardioid microphone.

13. An apparatus according to claim 1 wherein there are at least 8 transducers in the array.

14. An apparatus for producing audio signals representing a sound field including: a substantially planar circular array of omnidirectional microphones for receiving one or more sound waves from the field, a digital signal processor for calculating a Fourier transform of the microphone outputs at sample times, one or more filters for equalising each component of the Fourier transform, and a network for combining the equalised components into the audio signals.

15. An apparatus according to claim 14 wherein the Fourier transform of the mth output of the array of microphones is specified by:

$$s_m(t) = Ae^{j\omega_0 t}\sum_{l=-\infty}^{\infty} j^{m-lN} J_{m-lN}(kr)e^{-j(m-lN)\theta_0}$$

where $S_m(t)$ is the unequalised response of the microphone array, m is the mode of the array, N is the number of microphones, A is the amplitude of an incident sound wave from the field and $\theta_0$ is the angle of the sound wave.

16. An apparatus according to claim 15 wherein the unequalised response of the array to low sound wave frequencies is approximated by:

$$S_m(t) = Aj^m J_m(kr)e^{j\omega_0 t}e^{-jm\theta_0}.$$

17. An apparatus according to claim 16 wherein the one or more filters equalise the response by implementing the function:

$$E_1(\omega) = \frac{1}{j^m J_m(kr)}.$$

18. An apparatus according to claim 17 wherein the upper sound wave frequency at which the Fourier transform is equalised is increased by increasing the number of microphones in the array.

19. An apparatus according to claim 17 wherein the upper sound wave frequency at which the Fourier transform is equalised is increased by reducing the radius of the array.

20. An apparatus for producing audio signals representing a sound field including: a substantially planar circular array of first order microphones for receiving one or more sound waves from the field, a digital signal processor for calculating a Fourier transform from the microphone outputs at sample times, one or more filters for equalising each component of the Fourier transform and a network for combining the components into the audio signals.

21. An apparatus according to claim 20 wherein the approximate Fourier transform of the mth output of the array of microphones in response to low sound wave frequencies is specified by:

$$s_{m,\alpha}(t) = Ae^{j\omega_0 t}\sum_{l=-\infty}^{\infty} j^{m-lN}[\alpha J_{m-lN}(kr) - j(1-\alpha)J'_{m-lN}(kr)]e^{-j(m-lN)\theta_0}$$

where $S_m(t)$ is the approximate unequalised response of the microphone array, m is the mode of the array, N is the number of microphones, A is the amplitude of an incident sound wave from the field and $\theta_0$ is the angle of the sound wave.

22. An apparatus according to claim 21 wherein the one or more filters equalise the response by implementing the function:

$$E_\alpha(\omega) = \frac{j^{-m}}{\alpha J_m(kr) - j(1-\alpha)J'_m(kr)}.$$

23. An apparatus according to claim 22 wherein the upper sound wave frequency at which the Fourier transform is equalised is increased by increasing the number of microphones in the array.

24. An apparatus according to claim 23 wherein the upper sound wave frequency at which the Fourier transform is equalised is increased by reducing the radius of the array.

25. An apparatus according to claim 24 where $\alpha$ is set to ½ to produce cardioid elements.

26. A method for recording a sound field including; sampling sound waves from the field at a plurality of locations arranged in a substantially planar circular manner, calculating a Fourier transform of the sampled sound waves to specify the sound waves as a plurality of components, equalising each component to flatten the apparent frequency response of apparatus used for sampling the sound waves, and combining the equalised components to produce an audio signal representing the sound field.

27. A method according to claim 26 wherein the samples are equalised using functions based on one or more Bessel functions and/or derivatives of Bessel functions.

28. A method according to claim 27 wherein the range of wave frequencies over which the response is flattened is extended by sampling the sound waves at more locations.

29. A method according to claim 27 wherein the samples are taken at substantially evenly spaced locations about a circle.

30. A method according to claim 29 wherein the samples are taken from the output of transducers placed at each location.

31. A method according to claim 29 wherein the range of wave frequencies over which the apparent frequency response is flattened is extended by reducing the circumference of the circle.

32. A method according to claim 31 wherein the range of wave frequencies over which the apparent frequency response is flattened is extended to substantially the entire audio bandwidth by using transducers which are first order microphones.

33. An apparatus for use in recording a sound field including:

an array of transducer elements disposed in a substantially planar circular arrangement each of which produces an output signal in response to one or more incident sound waves from the field, a digital signal processor for calculating a Fourier transform of the output signals from the transducers to specify the sound waves as a plurality of components, and one or more filters for equalising each component to flatten the apparent frequency response of the array over at least a portion of the audio band.

34. An apparatus according to claim 33 wherein the one or more filters equalise the components using a function based on one or more Bessel functions and/or derivatives of Bessel functions.

35. An apparatus according to claim 34 wherein the array is a substantially circular arrangement of substantially equally spaced transducers.

36. An apparatus according to claim 35 wherein the Fourier transform of the output signals is calculated with respect to angular displacement around the array to provide the plurality of components which represent the angle dependent sound field incident on the array at an instant in time.

37. An apparatus according to claim 35 wherein the Bessel functions are selected based on components which contribute significantly to the magnitude of the sound wave.

38. An apparatus according to claim 35 wherein the significance of higher order components is reduced by reducing the radius of the array.

39. A method for recording a sound field including:

sampling sound waves from the field at a plurality of locations arranged in a substantially planar circular manner, calculating a Fourier transform of the sampled sound waves to specify the sound waves as a plurality of components, and equalising each component to flatten the apparent frequency response of apparatus used for sampling the sound waves.

40. A method according to claim 39 wherein the samples are equalised using functions based on one or more Bessel functions and/or derivatives of Bessel functions.

41. A method according to claim 40 wherein the range of wave frequencies over which the response is flattened is extended by sampling the sound waves at more locations.

42. A method according to claim 40 wherein the samples are taken at substantially evenly spaced locations about a circle.

43. A method according to claim 42 wherein the range of wave frequencies over which the apparent frequency response is flattened is extended by reducing the circumference of the circle.

44. A method according to claim 43 wherein the range of wave frequencies over which the apparent frequency response is flattened is extended to substantially the entire audio bandwidth by using transducers which are first order microphones.

* * * * *